United States Patent [19]

Kiss et al.

[11] 4,386,657

[45] Jun. 7, 1983

[54] PROCESS FOR THE UNDERGROUND GASIFICATION OF COAL AND CARBONACEOUS MATERIALS

[75] Inventors: Jozsef Kiss; Andras Solymos; Jozsef Berczes; Karoly Szabo, all of Tatabanya, Hungary

[73] Assignees: Központi Bányászati Fejlesztesi Intézet, Budapest; Tatabányai Szenbanyak, Tatabanya, both of Hungary

[21] Appl. No.: 142,340

[22] Filed: Apr. 21, 1980

[30] Foreign Application Priority Data

Apr. 20, 1979 [HU] Hungary ..... KO 2986

[51] Int. Cl.[3] ..... C10J 5/00; E21B 43/243

[52] U.S. Cl. ..... 166/261; 166/263; 166/292; 166/303

[58] Field of Search ..... 166/256, 257, 260, 261, 166/263, 302, 303, 272, 288, 285, 292

[56] References Cited

U.S. PATENT DOCUMENTS

| | | | |
|---|---|---|---|
| 2,695,163 | 11/1954 | Pearce et al. | 166/261 X |
| 3,076,505 | 2/1963 | Pryor | 166/262 |
| 3,332,482 | 7/1967 | Trantham | 166/256 X |
| 3,409,083 | 11/1968 | Prats | 166/256 |
| 4,018,481 | 4/1977 | Terry | 166/261 X |
| 4,031,956 | 6/1977 | Terry | 166/261 |
| 4,067,390 | 1/1978 | Camacho et al. | 166/303 X |
| 4,069,867 | 1/1978 | Bissett | 166/256 |
| 4,114,688 | 9/1978 | Terry | 166/261 X |
| 4,122,897 | 10/1928 | Capp et al. | 166/256 |

*Primary Examiner*—Stephen J. Novosad
*Attorney, Agent, or Firm*—Gabriel P. Katona

[57] ABSTRACT

A process for the underground gasification of coal and carbonaceous materials in makes the customary lengthy preliminary task of establishing an underground interconnection between wells and cavities unnecessary. Instead, according to the invention, the circulation of gasifying agents and product gases is between one or more wells and the boundary of an underground generator (i.e. cavity system) through a reaction zone in the generator.

9 Claims, 2 Drawing Figures

PROCESS FOR THE UNDERGROUND GASIFICATION OF COAL AND CARBONACEOUS MATERIALS

Figure 1:
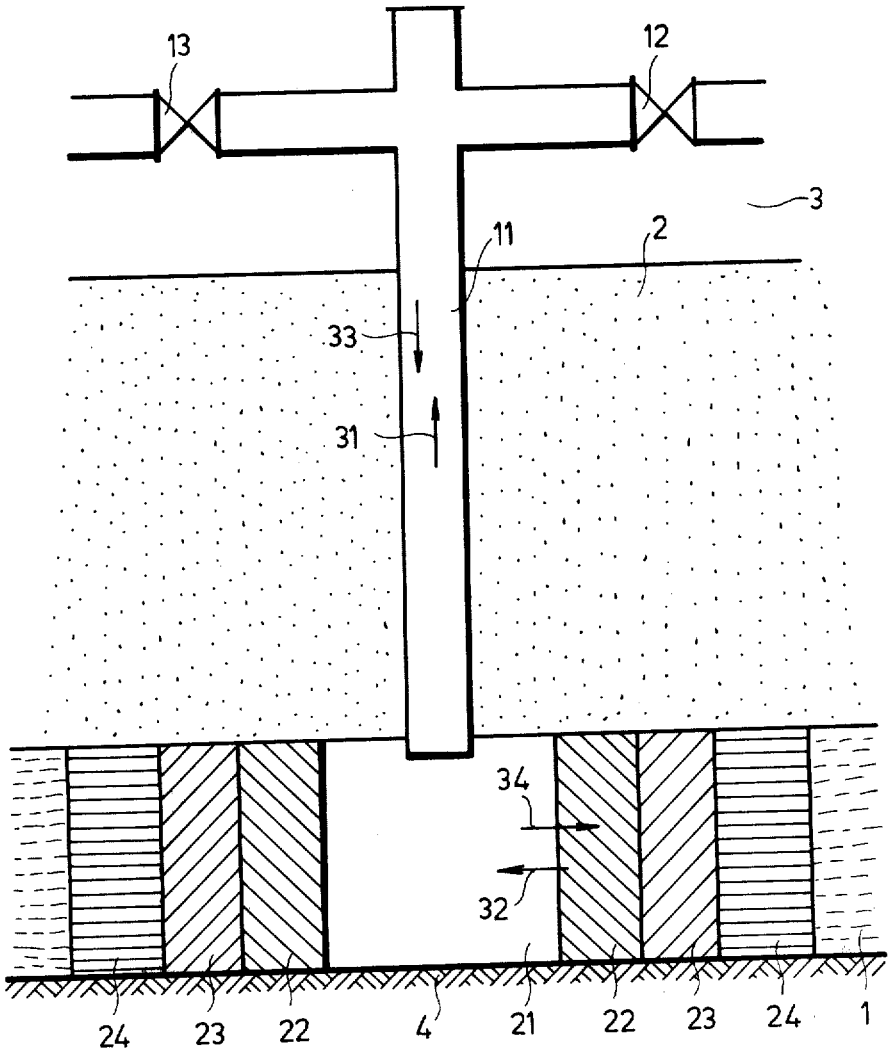

The invention concerns the underground gasification of combustible rocks, mineral oil and coal through wells bored from the surface as well as their conversion into gases which can be utilized as materials for heat and chemical energy carriers or as basic chemical materials.

A common feature of all hitherto known processes for the underground gasification through boreholes drilled from the surface is that the gasification of coal or other carbonaceous materials (hereafter referred to as "coal") is carried out with the aid of two or more boreholes (hereafter referred to as "wells"). The wells are interconnected through the coal by channels or cavities formed by any suitable process. In the process of gasification one part of the wells serves for passing the gasifying agent down to the coal seam, whereas the rest of the wells is used for the transportation of the generated gases to the surface. Although the processes hitherto used provide technical solutions, none of them can eliminate certain basic drawbacks. One of the great difficulties which in many cases excludes the applicability of such processes is the achievement of an effective underground interconnection of the wells. Another considerable disadvantage resides in the large residual losses of coal and the very low calorific value of the gases produced by using the process.

It is the object of the process according to the invention to eliminate, or at least to reduce substantially the difficulties of the known processes e.g. the complicated and lengthy job of establishing the interconnection of the wells and to provide a process, which renders possible the economic production of industrially utilisable gases of uniform quality accompanied by relatively low losses of coal. This object of the invention is achieved in that, instead of establishing a flow of gases between the gasifying wells, flow is set up between the well or wells and "the boundary of the generator" or the "generator boundary" (defined below) in such a way that one part of the gas fed in at high pressure through the well or wells passes through a reaction zone and during this process fills up the cavity between the reaction zone and the boundary of the generator. During this production process the free volume between the front of the reaction zone and the boundary of the generator is not only maintained but may, if so required, increase.

Since, according to the invention, the gasifying agent flows from the axis of the well toward the boundary of the generator and since a flow in the opposite direction can also be realized, the gasification of the coal seam can be achieved through one single well. However, in many cases it is advantageous to use a number of generators with single wells to perform the gasification of a larger area with satisfactory efficiency. By optimal design of the zones and directions of flow developed for industrial gas generators, it becomes possible to handle and control expediently the gasification processes, thus obtaining a uniform quality and a higher caloric value (combustion heat) of the gases produced. The gasifying agent forwarded down through the well is compressed and so reaches all parts of the underground generator.

In accordance with the terminology of this art, by "underground generator" is meant the totality of a system of cavities taking part in the gasification of the coal. "Generator boundary" (or "boundary of the generator") is the border line between the operating system of cavities participating in the gasification of the coal and the heated seam which has not yet started to be distilled or dried. An "underground generator with an independent well" means an underground generator developed during the process according to the invention wherein the gasification is carried out through one well.

"Gasifying agent" in general indicates a material or a component which forms a gaseous product with the coal. It is in most cases a gas, but may occasionally be a liquid or solid. Further particulars will be described later in this specification.

It should be understood that the invention is described hereinbelow in 2 examples illustrating the simplest embodiments of an underground generator with independent well in the accompanying drawings.

In the drawings

Figure 2:
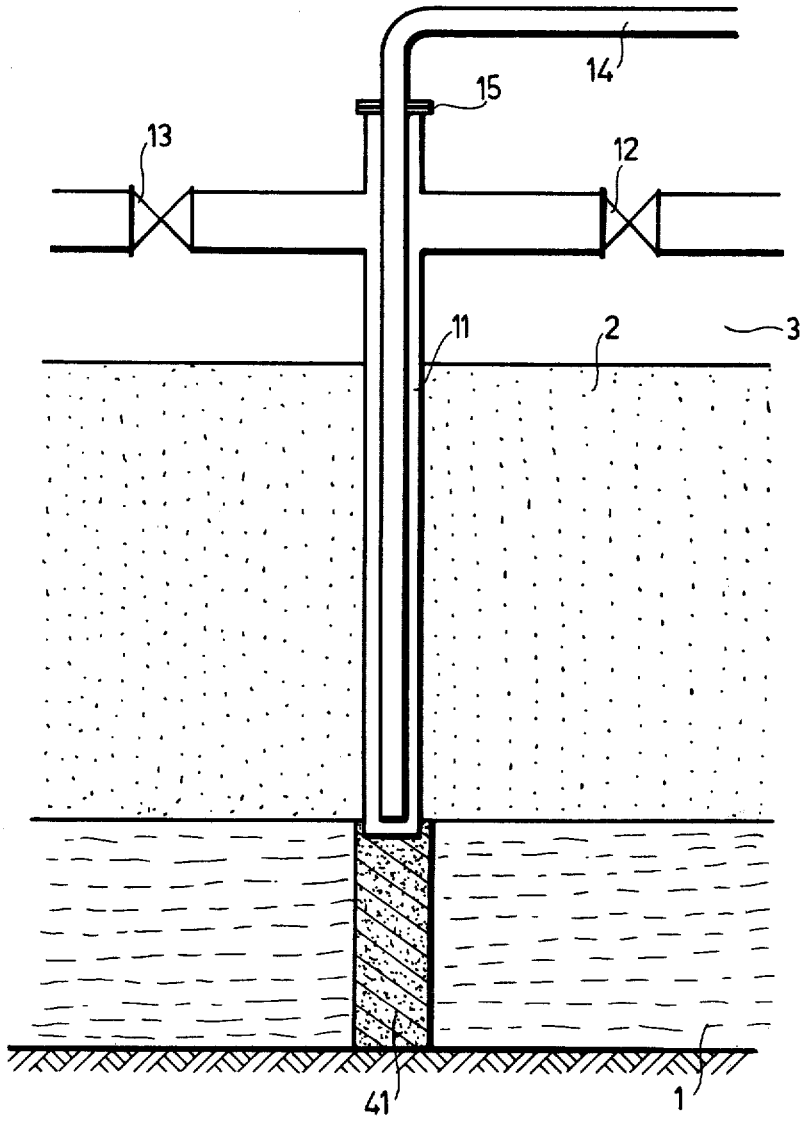

FIG. 1 is a skeleton diagram illustrating the underlying principle of the operation of the process according to the invention; and FIG. 2 illustrates the process in the phase of ignition.

EXAMPLE 1

FIG. 1 illustrates the two fundamental processes of the underground generator with independent well in the case of a well already in operation. The coal or other carbonaceous material from a seam 1 is gasified with the aid of a well 11 drilled through a top layer 2. The gasifying agents are forwarded down to the underground generator developed in the seam 1 via the same well 11 through which the converted (transformed) gases are released to the surface.

The process according to the invention consists of a sequence of cycles taking place one after the other. Eacy cycle has a compression phase and an expansion phase. During the compression phase the flow is directed in the direction of arrow 33 through the well 11 toward the generator and away therefrom in the direction of arrow 34. During the expansion phase the gases flow in the opposite direction indicated by the arrow 32 toward the well 11, then through it in the direction of arrow 31 toward the surface 3.

During operation of the underground generator with independent well, in each case a slag or cinder zone 21, a reaction zone 22, a distillation zone 23 and a drying zone 24 develop; and outside the zones of the generator a temperature gradient falling with increasing distance from the seam 1 develops in the seam. In the top covering layer 2 and in the bottom wall 4 limiting the seam 1 and the underground generator there also develops a temperature gradient that also drops with increasing distance from seam 1. During the compression phase, while the gasifying agent is being forced down from the surface 3 through well 11 into the generator, the pressure gradually increases in each zone and due to the developing pressure gradient, the gasifying agent flows from the well 11, toward the drying zone 24, i.e. toward the outer boundary of the generator. During this flow the gases in the generator and the gases forced in from the surface undergo certain transformations (conversions) in the individual zones and at the same time exert certain effects on the state of the zones, as will be explained in greater detail below. The gasifying agent flowing in through the well 11 into the slag zone 21 expels the gases therefrom and heats up. Essentially, the slag zone 21 operates as a regenerator in that it transfers heat to the gases passing through it while its temperature gradually decreases during the compression phase.

Since this zone does not affect the gasifying agent chemically, hereafter when this particular feature of this zone is referred to, the zone will be called the "passive zone".

The heated gases passing through the passive zone arrive at and enter into the reaction zone 22 where the decisive processes of gasification take place. This is the zone where the gasifying agent enters into a single-stage or multi-stage reaction with the coal content of the seam. The further the gas progresses, the higher will be its content of coal, up to the point where it reaches the state of equilibrium corresponding to the temperature.

If the gasifying agent contains oxygen, carbon dioxide is generated in the reaction zone 22:

$$C+O_2=CO_2 \quad (1)$$

If the temperature is high, carbon monoxide is formed until the temperature-related equilibrium is reached:

$$C+CO_2=2CO \quad (2)$$

From the steam contained in the gasifying agent, hydrogen and carbon monoxide are formed:

$$C+H_2O=CO+H_2 \quad (3)$$

and when the pressure is rising, methane is produced from the hydrogen forced down or generated in situ:

$$C+2H_2=CH_4 \quad (4)$$

while the coal content of the zone continuously decreases.

Although the heat required for operating the generator could be provided from an external source, it is more expedient to generate it within the generator. In this latter case, depending on the composition of the gasifying agent, the necessary amount of heat can be generated in the reaction zone 22. Where the gasifying agent contains oxygen and hydrogen the processes in the reaction zone 22 are exothermic and if it contains steam or water vapor instead of oxygen and hydrogen, endothermic processes will take place in the reaction zone 22. Hereafter, despite the fact that the heat could be provided from an external source, a preferred embodiment will be described wherein the heat necessary for the operation of the generator is provided by internal processes. In such cases the reaction zone 22 is the zone of the generator with the highest temperature and also provides the heat for the passive zone as well as the heat for the distillation and drying (desiccation).

The heat is transferred from the reaction zone 22 by the gases of higher temperature flowing into the distillation zone 23, partly by heat conduction along the gradient of temperature falling with increasing distance from the spot of the higher temperature. In this zone, the degree of distillation of the coal and the formation of decomposition products and consequently the extent of formation of cavities, correspond to the quantity of heat transferred into this zone, but this does not take place during the compression phase. Due to the rising pressures the decomposition processes slow down and partly counterbalance the rise in temperature.

It is the equilibrium vapor pressure corresponding to the rate of the increase of temperature and pressure which determines the amount and extent of the distillation and the rate of condensation of the previously distilled gases.

Due to the temperature gradient and the inflow of gases from the distillation zone 23 heat flows into the drying zone 24. The rate of drying of the coal corresponds to the amount of the transferred heat, therefore to the extent of formation of cavities due to the drying. Here also, the temperature and pressure corresponding to the place and time determine the equilibrium pressure of the water vapor and the amounts of water vapour evaporating and condensing. For this reason, although heat flows in during the compression phase, the drying period does not take place during this phase.

When at the end of the compression phase, the pressure in the generator reaches its planned maximum value, the inlet valve 12 is closed to stop the supply of gasifying agent and the phase is completed. By opening the discharge valve 13 the expansion phase of the cycle begins and the gas flows from the underground generator through the well 11 to the surface 3.

The first fraction flowing out through the well 11 is that portion of the forced-in gasifying agent which reached only as far as the slag zone 21 forming the passive zone, therefore only its temperature has been increased. The gases of the first fraction which did not reach the outer boundary of the passive zone but are at a higher pressure are allowed to pass into the adjacent well, if such is provided in order to utilize their heat and pressure.

At the boundary between the gases reaching the passive zone and the gases of the first period which flow from the reaction zone 22 towards the passive zone, mixing and chemical interaction takes place between the gasifying agent and the gases flowing out of the reaction zone. The oxygen of the gasifying agent reacts with the carbon monoxide to produce carbon dioxide:

$$2CO+O_2=2CO_2 \quad (5)$$

while the hydrogen therein produces water vapour:

$$2H_2+O_2=2H_2O \quad (6)$$

and from the methane carbon dioxide and water vapor are produced:

$$CH_4+2O_2=CO_2+2H_2O \quad (7)$$

Hence in the outflowing stream of gases the unchanged first fraction is followed by the second fraction containing inert gases. This process of mixing and transformation is completed when the bottom of the well 11 is reached.

The third fraction is composed of the outflowing gases which during the compression phase are passed from the gasifying agent into and through the reaction zone 22. Those gases which reached only the reaction zone 22 contain neither distillation gases nor hydrogen and carbon monoxide derived from the dissociation of water from the moisture content of the coal. Towards the end the third fraction contains the cracking products of the distillation process in ever-increasing quantities as well as carbon monoxide and hydrogen from the decomposition of the coal and from the moisture which are picked up by the gases that had entered into the distillation zone 23 and are entrained with them on their flow back into the reaction zone 22.

The outflowing fourth fraction consists entirely of the distillation gases, their cracking products, carbon monoxide and hydrogen from the water produced by the decomposition and drying. Since the third and fourth fractions comprise only combustible gases, they can be utilised together as a gas mixture, but by separating them a more valuable and a less valuable gas can be obtained.

The individual zones operate during the expansion phase according to their characteristics.

The gases passing through the slag zone 21 functioning as a regenerator are cooled down in the course of the expansion phase while the zone itself is heated up, its heat transferred during the compression phase being gradually replaced. In addition, due to the higher temperature of the reaction zone 22 in both phases of the full cycle, heat flows into the zone 21.

The gases flowing into—or passing through—the reaction zone 22 during the expansion phase undergo transformations correspondng to the level of the temperatures. In case of higher or lower temperatures, the distillate gases are cracked to a greater or lesser extent, respectively. Any water vapour entering dissociates into carbon monoxide and hydrogen until the equilibrium related to the actual temperature is reached.

Due to the increase in pressure the process of distillation or, by another name, gasification takes place in the reaction zone 22, and at the same time the gases condensed during the compression phase are also converted again to gas. The degree of gasification depends on the amount of heat accumulated during the compression phase and on the amount of heat transferred by heat conduction into the distillation zone 23 during the full cycle. At the completion of the expansion phase one part of the heat is consumed because the water vapor is heated up as it flows from the drying zone 24 into the reaction zone 22.

The drying of the coal in the desiccation zone 24 during the expansion phase is also due to the decrease in pressure. The amount of water evaporated during the full cycle depends on the heat which, due to the temperature gradient, enters and leaves the zone and also on the amount of heat accumulated during the compression phase.

The temperature of the drying zone 24 is higher than the temperature of the seam which is being gasified, and so heat is transferred beyond the boundary of the generator by a rate of flow corresponding to the prevailing temperature gradient.

The expansion phase is completed when the pressure of the outflowing gases decreases to the preplanned minimum level of pressure of the cycle. By closing the outlet valve 13 the expansion phase and thus one full cycle is completed. Although the basic processes of the successive cycles are identical, the internal state and the environment of the generator with an independent well change after each cycle and therefore the parameters of the successive cycles also change. Thus, inter alia, the radius of the boundaries between the individual zones, the cavity volume of the individual zones and the steepness of the temperature gradients emerging within the zones change. Accordingly, the minimum and maximum pressure of the cycles may have to be changed and the quantity of gas to be injected per cycle may have to be increased.

The methods and means of the preparation and ignition of the independent wells do not deviate from the means of the traditionally applied generators. The method of drilling the borehole of the well is identical with the already known methods. The fittings of the well differ only inasmuch as the downward flow of the gasifying agent and the conduction of the product gases in a different direction have to be achieved by a system of valves. In addition, provision has to be made for the fittings required for the feeding-in of the igniting material or ignition energy.

The starting up of the well begins with ignition which can be carried out by various technological methods. It is a common essential feature of all methods of ignition that the coal or the carbonaceous rock located in the vicinity of the borehole has to be heated up to a temperature which ensures that under the effect of the introduced gasifying agent, an amount of heat is generated which is sufficient to prevent a decrease in the prevailing temperature. From this point of view not only the temperature of the rock but also the quantity of the rock to be heated is an essential matter for consideration.

FIG. 2 illustrates one preferred example of the many possible methods of ignition. Charcoal or coke is heated up at surface level in a quantity sufficient completely to fill out the section of the borehole which has been drilled into the seam 1. The cover plate 15 is lifted together with the production pipeline is fastened to it to create a gap through which the incandescent charcoal or coke can be fed in down the well 11 into the seam 1. Thereafter, the cover plate 15, with a suitable heat-resistant packing, is fastened having an appropriate fitting by screws. Ignition starts when the glowing charcoal 41 engages the seam 1 and heats up the contiguous layers by heat conduction.

Before the charcoal 41 cools down below its temperature of ignition, air is pressed in through the production pipeline 14, while the inlet valve 12 and the outlet valve 13 are kept closed. During the introduction of the compressed air, the pressure increases in the enclosed space and the compressed air penetrates into the cavities or interstices in the charcoal. The feeding-in of the compressed air is continued until its pressure reaches the limit of the pressure-resistance of the top layer 2. Thereafter, by opening the outlet valve 13, the generated gases are let out via the well 11 while the pressure gradually drops. Meanwhile, the rate of supply of the gasifying agent into the production pipeline is decreased and in given cases completely stopped. When the pressure in the well has dropped to a value approximating the ambient pressure, the discharge valve 13 is closed and the supply of air via the pipe 14 is begun, and then set to full speed. The cycles are then continuously repeated successively after one another. During each cycle, in the course of the rise in pressure, oxygen penetrates into the gaps, interstices and cavities of the charcoal 41 in an amount sufficient to maintain it in incandescence. Meanwhile, the coal in the seam 1 is being distilled in the contiguous layer and the gases generated by distillation are burnt, thus generating heat. During distillation cavities are formed in the coal into which the air also penetrates.

The heated coal also creates cavities during drying. The coked part of the seam is also gasified due to the oxygen from the air, thus generating increasing amounts of heat. During the repeated cycles the quantity of charcoal constantly decreases from the top downwards but this is amply compensated by the radially expanded, coked, distilling and drying coal. Before the originally introduced quantity of the charcoal is completely used up, an ample supply of glowing coked, distilling and drying coal is produced which is sufficient for the process to become self-sustaining.

The process of the repetitive cycles will only be interrupted if the volume of the cavity formed around the well 11 has at least twice the volume of the section of the well 11, which is located in the top layer 2. At this point the production pipe line 14 is removed, the well fitting is closed by a cover and the operation of the well is started.

A successful operation of the process is characterized in that the ratio of the volume of the slag zone 21 representing the passive zone to the volume of the active zone constituted by the reaction zone 22, the distillation zone 23 and the drying zone 24, should be as low as possible. The larger the volume of the passive zone in relation to the volume of the active zone, the higher maximum pressure has to be applied to operate the generator. The gasifying agent forced in from the outside can only reach the reaction zone 22 if the pressure becomes so high that the gases contained in the volume of the passive zone pass into the active zone, i.e. the total quantity of gas contained in the two zones shrinks to the volume of the active zone.

If the geological and environmental conditions do not set a pressure limit, e.g. a top layer that is too thin, then a high volume ratio of the passive/active zones is economically disadvantageous, unless the high pressure energy of the gas is also utilised.

After the start of the generator, the ratio of volume of the passive/active zones is sufficient to satisfy all conditions. In the course of the aging of the generator the passive zone automatically and steadily increases but the volume of the active zone does not increase at the same time. In the course of its operation, the generator reaches the stage where it attains a dimension at which the necessary high pressure cannot be further increased, due to economic or environmental circumstances. For this reason, in order to increase the dimensions of the coal-containing area wherein the coal can be gasified by one generator (this area being hereafter referred to as "the field of the generator") and also to ensure an advantageous economy of operation, various technical means have to be applied to reduce the value of the volume ratio of passive/active zones during operation. This can be achieved in two ways. On the one hand, the volume of the passive zone can be reduced, and on the other hand, the gasification of the fixed carbon content of the seam can be slowed down within the active zone and the related speed of the distillation and drying can be increased. There is a variety of practical possibilities to satisfy the theoretical requirements.

According to a preferred embodiment, the volume of the passive zone can be reduced if mud is fed into the zone 21. The mud fills out a portion of the volume of cavity. The evaporable water content of the mud increases the water vapor content of the gasifying agent. The rate of supply of the mud can be regulated in such a way that it does not increase the water vapor content of the gasifying agent to the level at which the reaction zone 22 would cool down below the operating temperature.

Another possibility of reducing the volume of the passive zone is to mix additives to the gasifying agent in the form of powders the melting point of which is lower than the maximum temperature of the slag zone 21. In this case, the powder enters the slag zone 21 together with the gasifying agent, where only a small portion of it settles out in colder layers, whereas in the warmer layers farther from the well the powder particles melt and adhere to the surface. A fraction of the powder particles which may have been retained in the colder parts will drift forward during the subsequent cycles.

According to another advantageous embodiment, the rate of distillation and drying within the active zone can be increased by preheating the gasifying agent. In this case the rate of gasification of the fixed carbon content of the reaction zone 22 remains the same, but its temperature increases and the amount of heat transported into the distillation zone 23 and the drying zone 24 also increases. In addition, more heat flows by heat conduction into distillation zone 23 and the drying zone 24. All this means that more coal is being distilled and dried per cycle and the result is a larger active zone.

Another possible favorable embodiment is to increase the duration of the cycles by simultaneously lowering the minimum pressure of the cycle. In this case the lower terminal pressure of the cycle improves the yield of gasification and also a larger amount of moisture is evaporated. The longer period of cycle also enables more heat to be transferred into the distillation zone 23 and the drying zone 24, even at the same temperature gradient. Ultimately, this measure also increase the volume of the active zone.

A further preferred solution consists in reducing the carbon dioxide content, water vapor content and methane content of the fed-in gasifying agent. In this case the process equilibria in the reaction zone 22 are shifted towards one in which larger amounts of heat are formed therein. This results in a higher temperature in the reaction zone 22 without the rate of consumption of the fixed carbon content being increased. This also results in faster rates of distillation and drying, which in essence means a larger volume of the active zone.

Another example of a preferred solution consists in reducing inert gas content of the gasifying agent. More concretely, in the case of applying air, this means the enrichment of the air with oxygen whereby during the expansion phase less heat is transferred from the reaction zone 22 to the external surface. This also results in a higher temperature in the reaction zone 22 and unequivocally increases the volume of the active zone.

In order to reduce the volume ratio of the passive/active zones more than one of the described examples of preferred solutions can be applied together or in successive cycles. Without the application of such combinations economical production cannot be achieved. The changes in the value of the volume ratio can be monitored by determining the ratios of the generated product gases during production by means of continuous gas analysis. Since the methods used to reduce the ratio of passive/active zone volumes means extra expenditure, these methods are used as a function of the conclusions drawn from the analysis of the produced gases, by approximating the economic optimum.

If the seam 1 has a solid, porous structure and the pores of the combustible carbonaceous material are filled, e.g. in the case of certain oil wells, the cavities and the solid structure are uniformly distributed within the underground generator even in the slag zone 21. In this case the slag forming the solid structure prevents the caving-in of the top layer 2.

The distribution of the cavities and the slag structure will also be uniform for the distending (swelling) baking slags, provided that the ash content of the coal is not too low. By increasing the diameter of the slag zone 21, the top layer 2 exerts an everincreasing load pressure on the slag "frame". Depending on the mechanical strength of the slag "frame", the top layer 2 undergoes either negligible or substantial changes. In the case of a resiliently moving top layer 2 such changes may cause a swelling or distension into the slag zone 21. In the case of a yielding bottom wall 4 this may result even in swelling of the bottom wall 4. This reduces the volume of the passive zone, thus enhancing the operation of the generator. If the top layer 2 consists of a rigid material, the loose parts of the rock above the top layer 2 cave into the slag zone 21 of the generator. In this case, the gases flow also through the cavities formed in the top layer 2. The cavity volume of the passive zone will not, however, be smaller but extends only over a larger space.

The slag is located at the lower part of the slag zone 21, but the solid part can begin to disintegrate in the active zone to such an extent that at the top a coincident cavity expanding towards the slag zone 21 is formed if the mechanical strength of the burnt gasified, drying material is low and its structure collapses, respectively the slag is sintered or fused together at the temperature of the reaction zone 22. In this case the top layer 2 and the bottom wall 4 behave in the same way as previously described.

The inner structure of the underground generator with an independent well is also affected by a possible tendency of the coal to sintering and to swelling during distillation. The functioning of the traditional multi-well generator is hindered or even made impossible by the sintering, baked-together, swelling coal. On the one hand, the formation of interconnections among the wells is impeded by blocking the flow of air or oxygen generated by high pressure in cold state after the ignition of the well, even in the case of gasification using counterflow, because the swelling caused by the heat may eliminate the original, low permeability. For the same reason, the cross-section of the wells created by other methods e.g. by slanted boring, will also be reduced or fully blocked.

In contrast to the traditional processes, this cannot happen in the process according to the invention for the reason that the gasification is carried out through one well. In this case the swelling and the foaming caused by the drying pushes the solid material of the zones toward the well. This phenomenon reduces the volume of the cavities of the passive zone which improves the operation of the generator. The sintering coal is of no disadvantage to gasification either.

Generally, more than one underground generator with an independent well is necessary within the field of gasification. The dimensions of the generators increase during their operation and after a certain time of operation they will inevitably be interconnected. From this point of time the co-operation of the wells working together must be harmonized.

In the exploitation of gasification of a field or pit the location and establishment of neighboring wells must be planned in such a way that the wells which are already interconnected should enhance and promote each other's operation and should not hinder the harmonization of their operation. A scheme of exploitation wherein old and new wells are located close to one another is not expedient, because of the widely differing times of their respective operational cycles.

It is most convenient to choose the times of cycles so that they should be equal. Only temporary deviation from this is permissible. However, this does not mean that the cycles of the wells must be in phase. Nor is there need to let out the gases from each well in the ratio in which they were forced down in the compression phase.

A preferred example of the preplanned co-operation of the wells in when both the length and phase of the operational cycles of previously interconnected wells are identical with the rate of increase of pressure. This means that no substantial quantity of gas flows over from the volume of one generator into that of another generator; before transformation the gases flow downwards and through the well; after transformation the gases flow upwards through the same well and arrive at the surface. The advantage of this co-operation is an easy separation of the individual fractions of the product gases. Disadvantages properties manifest themselves, however, when the ages of the co-operating wells are different. In such cases, in the wells of the younger generators the rate of flow must be kept substantially lower than in the wells of the older generators. The wells of the younger generators are not fully utilized but the flow losses are lower.

In another preferred embodiment of the invention the length and phase of the operational cycles are identical but the rate of flow in the wells is so selected that it should be of nearly the same magnitude. If the generators are of the same age, there is no substantial change in the operation. If the ages of the co-operating generators are substantially different from one another this also means important differences from the point of view of their volume. In such a case, a considerable amount of gas flows over from the internal volume of the younger generators into that of the older generators. This, however, may be advantageous inasmuch as the seams between the wells are gasified faster by the system of generators.

A preferred embodiment of the invention regarding co-operation of the generators in addition to the harmonization of the operational cycles is characterized in that one part of the wells is operated mainly or wholly only during the compression phase, while the other wells are mainly at wholly operated only during the expansion phase. It is to be understood however, that in the system of co-operating generators there are some wells which operate in both phases. In this method of operation of co-operating generators, those generators that reached a stage where they are about to be shut down because they are almost completely exhausted due to old age are operated only during the compression phase, while others are operated mainly or wholly during the expansion phase, whereby to achieve that the heat of the heated rocks of the wells to be discontinued is utilized before the operation of the wells is finally terminated.

Another favorable embodiment is where the new wells are started either close to the perimeter of the ageing generator, or into the drying zone. In this case the system operates in such a way that the wells planted in the active zone work only during the expansion phase, while the wells in the passive zone are primarily operated during the compression phase. In this preferred embodiment the gasifying agent pressed down the well into the passive zone 21 during the compression phase flows through the same passage via the reaction zone 22, distillation zone 23 and the drying zone 24, as in the case of the original underground generator with an independent well, while the pressure steadily increases because the wells in one of the active zones are shut off. The wells in the passive zone are closed during the expansion phase and the wells of the active zone i.e. in the zones of distillation 23, or in the zone of desiccation 24 are open so that the transformed gasifying agent passing through the reaction zone 22 together with the distillation gases from the distillation zone 23 and the water vapors from the desiccation zone 24 are discharged through the wells. The produced gases differ in several ways from the underground generator with an independent well of the original construction. The gas products are not divided into fractions, therefore they do not contain an unconverted but gasifiable fraction. The water vapor derived from drying does not pass through the reaction zone 22, therefore it is not transformed into carbon monoxide and hydrogen but arrives at the surface as water vapor. Also the distillation gases are leaving the well in an unchanged original state, i.e. without cracking.

In this solution the field of gasification is exploited in such a manner that through those wells in the passive zones which are farthest away from the active zones the vicinity of such wells is filled with mud in order to prevent cracks that have occurred in the top layer from extending to the surface due to the loosening of the covering layer of rock, and the volume of the system of the generator should be closed. As the process of gasification proceeds in the field new wells are created in the drying zone 23 or directly outside the boundary of the generator in such a way that the generator should reach the boundary in a short time during the advance or progress of the gasification.

The underground generator with an independent well has a wide field of application but the methods of use differ in dependence upon the site of application. Hence, the application in different places or locations is described below by way of example. The process according to the invention is applicable for the gasification e.g. of lignite, combustible (oily) shales, brown coal, etc. which generally have a high degree of permeability and shrink strongly during desiccation. If the distillation gases have penetrated into the narrow cracks, they will block the cracks. In this kind of seam an underground generator with an independent well can be applied without restriction.

Also it can be applied more favorably than any other known method in the case of softening, swelling, sintering coals, anthracites, also without any change.

In seams containing coals of low calorie value there is a possibility for producing gases of low combustion heat. Similarly, in case of combustible shales, there is also a possibility for the operation and application of the generators.

Production is also possible in the case of depleted oil wells, but this requires higher pressure than the average. In this case, the working of the underground generator is based on the same principle as has already been described. This operation is characterised in that the porosity of the rock is not blocked and the generator is not limited along a perimeter.

The economy of the gasification depends on the depth and thickness of the seam to be gasified. Although very thin seams of a thickness of 20/30 cm can be still gasified with the aid of the underground generator with an independent well, the economy of the gasification depends on the thickness of the top layer. The amount of exploitable energy increases with a decrease in temperature and with an increase in the rate of gasification of the field of generators. With decreasing seam thickness the heat losses per unit time increase in the direction toward the top layer 2 and the bottom wall 4. This can be counterbalanced by the rate of exploitation and by the reduction of temperature in the reaction zone 22. The rate of exploitation can be increased by reducing the cycle times and by increasing the quantity of gasifying agent forced down per cycle. A precondition of this is an increase in the diameter of the wells and an increase of the rate of flow during the phases of compression and expansion. Due to the smaller thickness of the layer a higher rate of progress of the zones is achieved for the same cycle times and the same gas circulation per cycle.

Coals of high caloric value can be gasified without any obstacles. In the case of gasification of coals of low caloric value, the temperature of the reaction zone 22 steadily decreases due to the high ash and moisture content. As a result, the caloric value of the gaseous products also decreases. With the reduction in temperature, the dissociation of the water does not take place and the gaseous products exit through the well in the form of water vapor. The extent to which the caloric value of the seam may drop is such that the temperature of the reaction zone 22 drops below 400°–450° C. at which the operation of the generator cannot be sustained. In such cases the operation can be assured by the preheating of the gasifying agent in an external generator. Using an external generator and efficiently applying the internal generators, a seam having a thickness of 2 meters and a caloric value of 1500 kcal/kg can still be well gasified. Below this thickness, local conditions will determine the possibility of gasification. A precondition of successful gasification is here again that the cycle time per unit volume of gas circulation is reduced.

The coal generally does not occur in a single seam but in a group comprising a plurality of seams. The thickness of the dead rock wedged in between the seams varies between wide limits. If the distance between the seams does not exceed 40–50 meters, it is expedient to gasify the seams through one well and at the same time. This solution reduces the losses occuring by heat conduction in the direction of the top layer 2 and the bottom wall 4. For analogous reasons, the thin or somewhat thicker seams of combustible shales of low value of heat of combustion, the exploitation of which would be otherwise uneconomical, may still be advantageously gasified by the process of this invention. The simultaneous gasification of the seams is achieved by simultaneous ignition. If the main seam is located below the other seams and the thickness of the dead rock wedged in between the seams located above the main seam does not exceed a few meters, then due to the loosening of the seams, these upper seams will automatically ignite. If there are seams below the main seam, automatic ignition happens only if the layers of dead rock are thinner than the main seam.

The technology of underground gasification with an independent well can be favorably applied to the gasification of the coal residues of already depleted coal basins and shafts which may contain several tens of millions of tons of coal. The product gases obtained from such basins may prolong the duration of economical supply of energy for power generating stations and housing estates centred on such coal basins. In such cases the individual fields of gasification are naturally smaller and the production less intensive. The transport of gases by a pipeline connected to a main pipeline network represents a viable solution. It may also represent a solution in the case of a smaller number of underground generator groups located at a greater distance if the gases produced in situ can be transported by vehicles to the place of utilisation.

The existence of coal residues may have several reasons. Thus, e.g. to exploit the residual fields of coal, open roads or gangways of uneconomic cost would have been necessary. In other areas the seam became so thin that the exploitation became uneconomic. In yet other cases, the danger of explosion due to coal dust, the hazard of gas outburst or a high methane concentration caused the exploitation to be stopped.

The process according to the invention is suitable not only for the gasification of the residual materials of coal seams, but also for exploiting oil field residues; however in such cases the operation of the underground generator with an independent well is different from the one described. This kind of operation is described below by way of example.

Example

The mobile portion of the organic material of a porous and permeable layer is displaced towards the well during exploitation of the oil. The solid bituminous portion(s) or parts of high viscosity located in the surface of porous cavities and in the cracks of limestones cannot be exploited without the application of heat treatment. The residue may even exceed 50%. In the oil industry the method of production by partial combustion of the oil finds steadily increasing application. The gasification by means of an independent well according to the invention may also be used here to advantage. As distinct from the underground gasification of coal, attention has to be paid here to the fact that the generators will not have a well-defined boundary.

During the compression phase at increasing distances from the well, the pressure gradient is substantially higher than in the case of coal, because the permeability of the porous material is much smaller.

The gases push the liquids flowing in the pores ahead of themselves. The pressure gradient in the flowing liquid is even steeper due to the fact that its viscosity is higher by 2-3 orders of magnitude. The rate of flow of the liquid zone will therefore be lower than the rate of flow of gas. This enables a continuous steep increase of pressure in the gas zones during the compression phase. The pressure increasing in the active zone enables in this case also to pass the gasifying agent through the passive zone and to enter into the reaction zone 22 of the active zone, wherein it enters into chemical reaction with the coked organic material contained therein to gasify it. In the course of this reaction heat is also being transferred by the flow of gases into the distillation zone 23, where the oils of high viscosity are converted into vapor and decompose the bitumens by coking. If the pores of the oil seams contain water, the heat transferred into the drying zone 24 heats up the aqueous wet surfaces and evaporates a portion of the water. Finally, at the generator boundary the gases drive the liquid phase in front of them, steadily extending the boundaries of the generator. Thus, the active zones of the generator improve (extend) the volume of the active zone with the aid of the extended boundaries of the generator that have been extended during the compression phase.

During the expansion phase the gases are let out through the well. In this case also the first exiting fraction contains the completely oxidised phase and the third fraction consists again of gases which CO and $H_2$ content, while the fourth fraction is enriched in oil and in decomposition products of bitumen.

In this case, it takes a longer time for the flow to turn outwards on the boundary of the active zone during the expansion phase. After this, the active volume of the generator continues to increase but this increase of volume is no longer advantageous because it does not increase the quantity of gasifying agent flowing into the active zone. When the gas/liquid boundary is displaced towards the well and continues moving in this direction during the expansion phase, the pressure decreases more slowly than in the case of an underground generator having an independent well and a fixed boundary.

The boundary of the generator moves during one cycle of gasification from a maximum to a minimum. However, this cycle lags behind the cycle developed at the mouth of the wells. The maximum and minimum boundaries of the generator increase (extend) during successive cycles. The minimum pressure of the generator and the duration of the cycle time has to be set in such a way that the minimum diameter of the well during a cycle should not reach the distillation zone 23 if the mobile medium is water.

If the oilfield has a plurality of oil wells, it is expedient to operate the generators with identical cycle times but in the interests of utilisation of the liquids moving between the wells and in order to reduce the ratio of the active/passive volume, it is advantageous to offset the phase of cycles of the wells.

The process is applicable not only for the gasification of flat level layers and layers with slightly slanting seams, but also for the exploitation of coal seams of steep gradient. The course of the cycles is in no way different, the course of gasification of the generator field is however different and the shape of the generator does not approximate a geometrical shape of axial symmetry but rather it approximates the shape of one with a planar symmetry.

The course of the gasification is influenced primarily by the fact that the well is not perpendicular to the coal seam and therefore the length of the transversal section of the well crossing the seam is bigger: a substantially larger amount of coal can be gasified with one well. The ignition of the well is carried out at the lowest point of the well where it crosses the seam. In this case the gasification initially takes place in the deepest parts of the seam, and thereafter extends upwardly in the vicinity of the well. In the case of a seam of steep gradient (inclination) the loosening of the top layer promotes the upward extension of the generator field belonging to the well. As a result, in the case of steeply inclined seams, the quantity of gasifiable coal can be increased to a multiple.

In the case of very deeply-lying coal seams, e.g. at more than 1000 meters below the surface, all advantages and disadvantages of the traditional underground gasification are also present in the process according to the invention. The long wells here also increase the costs, while the danger of environmental pollution is here smaller. But it is a particular and substantiall advantage of the process of gasification according to the invention that the possibility of increasing the pressure substantially increases the dimensions of the generator field. Even in such great depths there are no technical difficulties involved in increasing the maximum pressure above a value of 1000 bars. This renders possible the realisation of a generator field with a radius of extension of 50 meters. For the purpose of the process according to the invention, a gasifying agent best suited to the aim and the seam may be selected freely. The gasifying agent is generally a gas but occasionally it may be a liquid or a solid material.

In order continuously to provide the free volume of the zones of distillation and desiccation necessary to carry out the process of gasification according to the invention, if the underground generator cannot provide the necessary amount of heat by the heat from the reaction zone, such heat has to be supplemented from outside the system. In such cases an inert gas is used as the gasifying agent or as a component thereof, which has no function other than that of being heated up outside and transferring heat into the distillation and desiccation zone.

In practice the best available gasifying agent is air. A portion of the air is required for heat transport when it behaves like an inert gas. The oxygen contained in the air forms carbon monoxide and carbon dioxide with the "fixed" carbon. At the same time heat is generated in the reaction zone in proportion to the ratio of carbon monoxide to carbon dioxide. The success of the process depends on the proportion of heat which is generated in the reaction zone and obtained from outside and entering the zones of distillation and desiccation.

Pure oxygen or oxygen-enriched air assures the gasification of more fixed carbon per cycle than air: more heat is generated in the reaction zone and the temperature is higher.

Water vapor can also be used as a gasifying agent or as a component of a gasifying agent. The water vapour can gasify the fixed carbon in the reaction zone if the temperature of the zone is high enough to produce carbon monoxide and hydrogen from the water vapor and coal in accordance with the equilibrium of the reaction.

In certain special cases, carbon dioxide may also be used as a gasifying agent or as a component of a gasifying agent. A portion of the carbon dioxide is transformed according to the equation (2) into carbon monoxide in the reaction zone 22. The transformation is more efficient at higher temperatures and lower pressures. The carbon dioxide as a component of a gasifying agent cools the reaction zone 22, because this process is endothermic.

Hydrogen may be used as a gasifying agent where high pressure is applied for gasification. The hydrogen gasifies the fixed carbon in the reaction zone 22 and methane gas is formed. This process takes place with a greater yield at increasing pressure. The reaction is exothermic therefore the reaction zone 22 does not cool down.

Sulphur can also be used as a gasifying agent. The transformation (conversion) takes place according to the equation:

$$C+2S=CS_2 \quad (8)$$

on passing sulphur through a glowing hot coal layer. The sulphur may be supplied to the generator in a gaseous form. The gasifying agent can expediently be applied only if the carbon disulphide can be utilized or if the recovery of the sulphur is economically justified under the prevailing local circumstances. The transformation of the sulphur needs heat, therefore it cools down the glowing coal layer if this heat loss is not compensated. The process may expediently by applied for the purpose of producing methane and hydrogen sulphide with the aid of a molybdenum catalyst according to the equation:

$$CS_2+4H_2=CH_4+2H_2S \quad (9)$$

In this case, the sulphur can be recovered and reutilised.

Under special local conditions, sulphur dioxide may also be used as a gasifying agent. The transformation takes place according to the equation:

$$C+SO_2=CO_2+S \quad (10)$$

when the sulphur dioxide is passed through a glowing coal layer. This transformation is exothermic, therefore increases the temperature of the reaction zone 22. It is a great advantage of the application of sulphur dioxide as a gasifying agent that it can gasify the same amount of fixed carbon per unit volume as oxygen, but its manufacture is cheaper. At temperatures above 800° C. the process can be continued and the sulphur is transformed into carbon disulphide but even this does not cause any cooling down of the reaction zone 22. The process develops in another direction also and a reaction according to the equation:

$$2C+SO_2=2CO+S \quad (11)$$

takes place. The higher the temperature of the reaction zone 22, the greater is the extent of this process. However, this is an endothermic reaction which over longer periods of time cools down the temperature of the reaction zone 22 to such an extent that the transformation can only continue according to the equation (10).

Considering the circumstances of utilization of the seam, the top layer and the environment, a large variety of gases can be produced by the process of the underground gasification with an independent well. The versatility of the possible variations of the process according to the invention may in some cases be reduced due to natural restrictions, but in favorable circumstances it offers more and better possibilities than the traditional processes. Due to the wide range of possibilities the most frequently occurring variations are illustrated by way of example of preferred embodiments. The most difficult circumstances and the minimum of freedom of choice are created by very thin seams or seams which, though thicker, have a very low caloric value. In the case of such seams only hot inert gas can be produced at the gasification, the temperature of which does not exceed 600°-700° C. It is an added possibility if valuable distillation gases are generated, which can be separated into discrete fractions and the tar-products are marketable. The utilisation of the hot inert gas is possible in a power generating station located nearby. If this is not possible, the local production for the purpose of distillation of liquids, heating of water or steam also represent a certain solution but in case of very deep-lying seams this can only exceptionally be economical.

In the gasification of thick seams and materials of higher caloric value hot combustible gases are produced and also there is a possibility of separation of the fractions of the cracked distillation gases. If the hot combustible gas need not be transported over great distances, it can be utilized without cooling in power generating stations or chemical plants, where it can be utilized by combustion. The residues of the distilled gases and their cracked products can be caught in the separated fraction and can likewise be utilized.

In seams located in the vicinity of a nitrogen-based fertilizer manufacturing plant or other industrial plants using synthetic gas, where it is economic to transport the manufactured gas via a pipeline or by other means to a given distance, the operation of the generator can be directed in such a way that the fraction generated by the gasification is influenced by the choice of the composition of the gasifying agent. One way of realizing this is the selection of optimum sections for the fractions created in the course of gasification. The other possibility is the selection of the suitable gasifying agents. The production of gases that can be economically transported over long distance—the so-called cold "distance gases"—can be obtained directly in seams located at greater depths. The most convenient type of the "distance-gas" are hydrocarbons, primarily methane. Such gases can be produced partly by generators which are developed at great depths, partly by using hydrogen as a gasifying agent. The hydrogen as a gasifying agent provides the material for the producton of methane or hydrocarbon for the coal from which the methane is produced by an exothermic reaction. The reaction equilibrium is shifted toward the generation of methane by high pressure, which can only be produced in the case of the seam being located very deep underground. The methane content can also be developed by high pressure by using water vapor as a gasifying agent, provided the hydrogen generated enters into chemical reaction with the carbon. Another example of utilization of the product gases is afforded where a high pressure gas can be produced because of the thickness of the top layer, and inert gas is produced in view of the properties of the coal seam. In such cases, the high pressure can be utilized for energy production. Due to the high pressure, the equilibrium of the reaction is shifted towards $CO_2$ even at higher temperatures. The high pressure gas can be converted directly into energy in gas turbines. In this case, it is the pressure and temperature of the gas which is being utilized for the generation of energy. The residual temperature of the expanded gases can be utilized in the same way as in the case of an inert gas at low pressure.

It is also a favorable condition for the applicability of the process according to the invention that its operation can be adapted to the requirements and demand. In periods of low demand the possibility of operating the reaction zone 22 hot is exploited, and the volume of the active zone is increased by prolongation of the cycle. In periods of peak demand the developed favorable situation can be utilized and greater quantities of gas of higher caloric value than would be the case with uniform operation are produced.

We claim:

1. In a process for the underground gasification of seams of coal and other combustible minerals within an underground generator by means of gasifying agents, wherein a well is provided in the seam to be gasified, an ignition means is brought into the bottom of said well, the seam around the bottom is heated by said ignition means in alternating compression and expansion phases, the improvement comprising (1) forming an active and a passive zone around the bottom of the well within the seam, the passive zone being nearest the well and being formed by slag of previous combustions in the active zone, the active zone comprising a reaction zone around the passive zone, a distillation zone surrounding the reaction zone, and a desiccation zone surrounding the distillation zone, the underground generator consisting of said active and passive zones;

(2) injecting gasifying agents through said well into said reaction zone under pressure, thus forming said compression phase, forcing gaseous products beyond the reaction zone into the distillation and desiccation zones, but not beyond the boundary of the generator, (3) releasing pressure, thus forming said expansion phase and causing gases to flow out from the generator through said well, and (4) maintaining a large volume of the distillation and desiccation zones by sustaining the temperature of the reacton zone at a value enabling heat to flow into the distillation and the desiccation zones.

2. The process according to claim 1, wherein the maximum pressure applied during compression is increased in accordance with the gas permeability and the compressive strength of the top layer of the rock.

3. The process according to claim 1 wherein the volume ratio of the active to the passive zone is controlled with a view of keeping the value of the passive zone in the ratio as low as possible.

4. The process according to claim 3, wherein the volume of the active zone is increased by increasing the $O_2$-or $H_2$-content of the gasifying agent, or by reducing the $H_2O$-, $CO_2$-content and the content of other heat consuming material thereof.

5. The process according to claim 3, wherein the volume of the passive zone is reduced by feeding a pore-blocking material down the well.

6. The process according to claim 5, wherein the pore-blocking material is a thermo-swelling material of high pore volume which preserves its gas permeability and after solidification is transformed into a solid material capable of preventing cave-in of the top layer.

7. The process according to claim 1, characterized in that in an environment for the generator which is prone to water inrush, the pressure is reduced at the completion of the expansion phase only to an extent which still insures adequate counter-pressure against the pressure of water.

8. The process according to claim 1, where, in addition to the generator with one well, several such generators are used wherein in the course of aging of the generators the wells, which become automatically interconnected, are operated together and their working cycles are operated in synchronism.

9. The process according to claim 8, wherein the gasifying agent, which has been introduced into the generator, but has not reached the active zone and which therefore is recovered unchanged during the expansion phase, is introduced into an adjacent generator of the same construction, in order to utilize its acquired temperature and pressure.

* * * * *